United States Patent [19]

Yamazaki et al.

[11] 4,153,078

[45] May 8, 1979

[54] COMPOSITE VALVE

[75] Inventors: Masami Yamazaki, Toyota; Masahisa Ando, Aichi, both of Japan

[73] Assignee: Toyota Jidosha Kogyo Kabushiki Kaisha, Japan

[21] Appl. No.: 838,305

[22] Filed: Sep. 30, 1977

[30] Foreign Application Priority Data

Jun. 13, 1977 [JP] Japan ..... 52-76826

[51] Int. Cl.[2] ..... F16K 27/02

[52] U.S. Cl. ..... 137/882; 137/DIG. 8; 137/881; 137/885; 60/290

[58] Field of Search ..... 137/DIG. 8, 881, 882, 137/884, 885; 60/290

[56] References Cited

U.S. PATENT DOCUMENTS 3,529,624 9/1970 Cryder et al. ..... 251/361 X 3,540,478 11/1970 Ito ..... 251/61.5 X 3,911,674 10/1975 Goto et al. ..... 60/290

*Primary Examiner*—Gerald A. Michalsky

*Attorney, Agent, or Firm*—Stevens, Davis, Miller & Mosher

[57] ABSTRACT

A composite valve made of a first dish-like member having an open face and concaved portions defining diaphragm chambers, a second dish-like member having an open face and concaved portions defining complex passages, an intermediate member having opposite open faces opposing the open faces of the first and second dish-like members and complex partitions defining bearing portions and complex passages, a diaphragm element interposed between the first dish-like member and the intermediate member, valve elements slidably mounted in the bearing portion and connected to the diaphragm element, and valve seat elements interposed between the second dish-like element and the intermediate member and providing valve seats.

8 Claims, 8 Drawing Figures

COMPOSITE VALVE

BACKGROUND OF THE INVENTION

The present invention relates to a valve and, more particularly, to a composite valve including a plurality of valve means incorporated as an integral structure therein.

It is often desired to combine a plurality of valves which operate in relation to each other into a single composite valve. By providing such a composite valve, piping between a plurality of separate valves may be omitted and an entirely compact fluid control means is available. A composite valve is particularly effective as a control means to be incorporated in the secondary air supply system for supplying secondary air to the exhaust system of an engine for the purpose of purifying exhaust gases.

When several valves are combined into a composite valve, the design of the exact structure of the composite valve is of course determined in accordance with the particular requirements with regard to the composite valve. However, as a general structure, conventional composite valves have been designed so as to have a housing which is a unitary member or an assembly of several parts and incorporates therein several ports, valve seats, and internal passages required, to which various valve elements and valve actuating means such as diaphragms are individually assembled. In most cases the housings of conventional composite valves are of complicated three-dimensional designs which require complicated manufacturing processes, and, furthermore, they require a large amount of work for assembling individual valves and valve actuating means such as diaphragms into the housings, thereby naturally increasing their cost.

SUMMARY OF THE INVENTION

It is therefore the object of the present invention to provide a novel composite valve having a simple structure which is easy in design, manufacture, and assembly.

In accordance with the present invention, the above-mentioned object is accomplished by a composite valve comprising a first dish-like member having an open face and concaved portions which define a plurality of diaphragm chambers, a second dish-like member having an open face and concaved portions which define complex passages, an intermediate member having opposite open faces adapted to join said open faces of said first and second dish-like members and complex partitions which define bearing portions and complex passages, a diaphragm element interposed between said open faces of said first dish-like member and said intermediate member, a plurality of valve elements having stem portions mounted in said bearing portions and stem end portions connected to said diaphragm element, and seat elements interposed between said open faces of said second dish-like member and said intermediate member and providing valve seats which co-operate with said valve elements.

BRIEF DESCRIPTION OF THE DRAWING

The present invention will become more fully understood from the detailed description given hereinbelow and the accompanying drawings which are given by way of illustration only and thus are not limitative of the present invention and wherein.

DESCRIPTION OF THE PREFERRED EMBODIMENT

Figure 1:
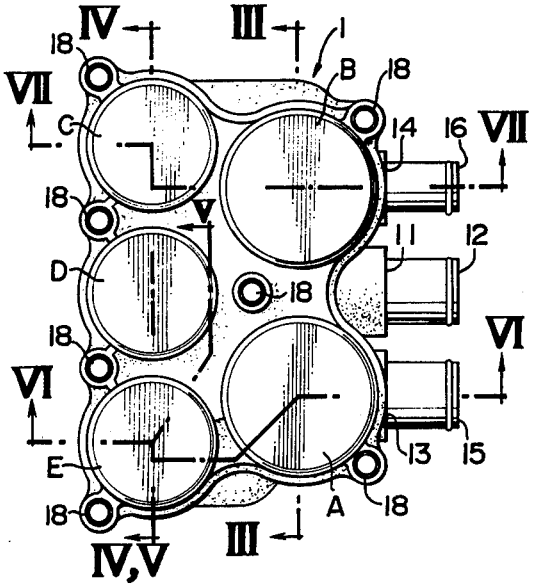
FIG. 1 is a plan view of an embodiment of the composite valve according to the present invention.

Referring to the drawings, the composite valve herein shown is particularly designed as a control valve for a secondary air supply system for purifying exhaust gases of an engine. In these figures, 1 designates a first dish-like member having an open face and concaved portions which define a plurality of diaphragm chambers. In this embodiment the composite valve is designed so as integrally to include five valve means A, B, C, D, and E, and therefore the first dish-like member 1 has five concaved portions designated by 1*a*, 1*b*, 1*c*, 1*d*, and 1*e* for the valve means A–E.

Reference numeral 2 designates a second dish-like member which also has an open face and concaved portions, wherein the concaved portions are adapted to define complex passages. The concaved portions are designated by reference numerals 2*a*, 2*b*, 2*c*, 2*d*, and 2*e*. Between the first and the second dish-like members is provided an intermediate member 3 having opposite open faces adapted to join said open faces of said first and second dish-like members and complex partitions which define bearing portions 3*a*, 3*b*, 3*c*, 3*d*, and 3*e*, and complex passages designated by 3*f*, 3*g*, 3*h*, 3*i*, 3*j*, etc..

A diaphragm element 4 is interposed between the opposite open faces of the first dish-like member 1 and the intermediate member 3. In the shown embodiment, the diaphragm element 4 is formed as a unitary element which provides diaphragm elements for all diaphragm means for operating valve means A–E, i.e., it includes diaphragm portions 4*a*, 4*b*, 4*c*, 4*d*, and 4*e* corresponding to valve means A–E. In the bearing portions 3*a*, 3*b*, 3*c*, and 3*e* are individually slidably mounted shaft portions of valve elements 5*a*, 5*b*, 5*c*, and 5*e*. End portions of these valve elements are individually connected to the diaphragm portions 4*a*, 4*b*, 4*c*, and 4*e* of the diaphragm element 4. At individual diaphragm portions 4*a*–4*e*, disk elements 6*a*, 7*a*, 6*b*, 7*b*, 6*c*, 7*c*, and 6*e*, 7*e* are mounted on the opposite sides thereof and are fastened together with the diaphragm element by means of the end portions of the valve elements which penetrate therethrough and nuts 8*a*, 8*b*, 8*c*, and 8*e* screwed onto the shaft end portions of the valve elements, thereby establishing actuating connection between the individual diaphragm portions and the valve elements. In the case of the valve means D, the disk portion of a valve element 5*d* is directly mounted on the one side of the diaphragm portion 4*d* in a manner that a stub shaft portion provided at a central portion of the valve disk portion is penetrated through the diaphragm portion 4*d* and a disk element 6*d* provided on the other side thereof and the end portion of the stub shaft portion is enlarged by plastic deformation so as to fasten the integral connection of the valve element 5*d*, the diaphragm portion 4*d* and the disk element 6*d*. The diaphragm portions 4*a*–4*e* are exerted with biasing force by compression coil springs 9*a*, 9*b*, 9*c*, 9*d*, and 9*e*, respectively.

Between the opposing end faces of the second dish-like member 2 and the intermediate member 3 are interposed valve seat elements 10*a*, 10*b*, 10*c*, and 10*e* providing valve seats which co-operate with valve elements 5*a*, 5*b*, 5*c*, and 5*e*. For valve element 5*d*, a portion of the intermediate member 3 directly provides a valve seat 10*d*.

The intermediate member 3 has a port 11 formed at a portion thereof, in which is mounted a stub tube element 12. The port 11 communicates to the passage 3*f*. The second dish-like member 2 is formed with ports 13 and 14 in which are individually mounted stub tube elements 15 and 16. The port 13 communicates to the passage 2*a*, while the port 14 communicates to the passage 2*b*.

Figure 2:
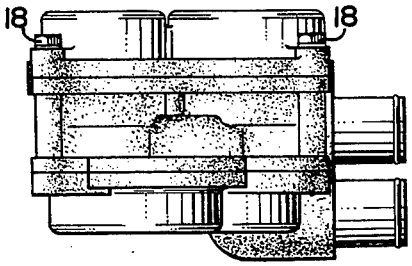
FIG. 2 is a side view of the composite valve shown in FIG. 1.
Figure 4:
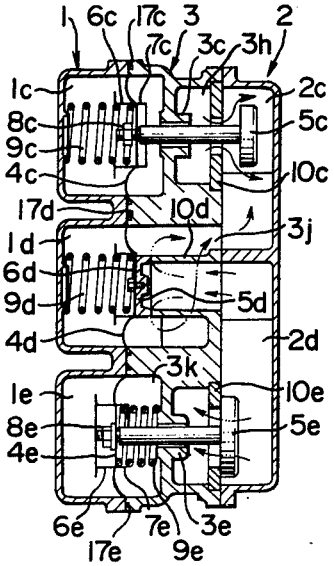
FIGS. 3–7 are sectional views along lines III—III, IV—IV, V—V, VI—VI and VII—VII in FIG. 1, respectively.
Figure 3:
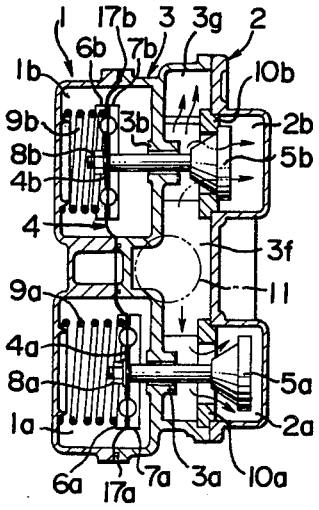
Figure 5:
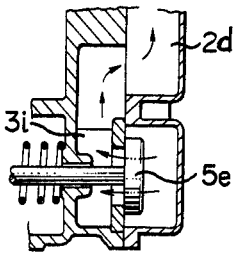
Figure 6:
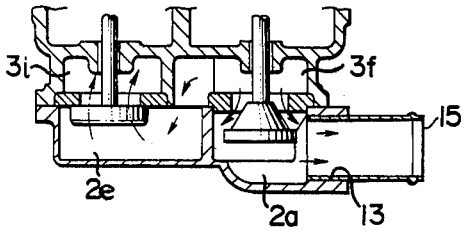
Figure 7:
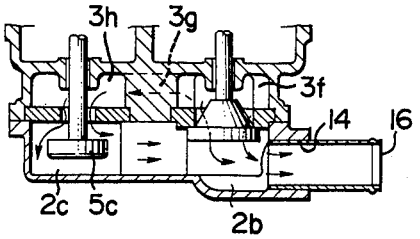

Along the joining surfaces of the diaphragm element 4 and the intermediate member 3, corresponding to diaphragm portions 4*a*–4*e*, annular sealing elements 17*a*, 17*b*, 17*c*, 17*d*, and 17*e* are provided. Furthermore, although it is not shown in the figure, any proper sealing means such as a gasket may be provided along the joining surfaces of the diaphragm element 4 and the first dish-like member 1 and of the second dish-like member 2 and the intermediate member 3. The first and second dish-like members 1 and 2 and the intermediate member 3 interposed therebetween are, as best shown in FIG. 2, clamped together by a number of bolts 18.

In the composite valve thus assembled, the concaved portions 1*a*–1*c* provide diaphragm chambers which are supplied with control fluid pressure through plug port means (not shown in the figure) mounted to penetrate the wall portions of the first dish-like member 1, said control fluid pressure controlling displacement of individual diaphragm portions 4*a*–4*c* thereby controlling operation of the individual valve means A–C. Similarly, a plug port means (not shown) is mounted to a wall portion of the intermediate member to provide a connection of control fluid pressure to a chamber 3*k*.

Figure 8:
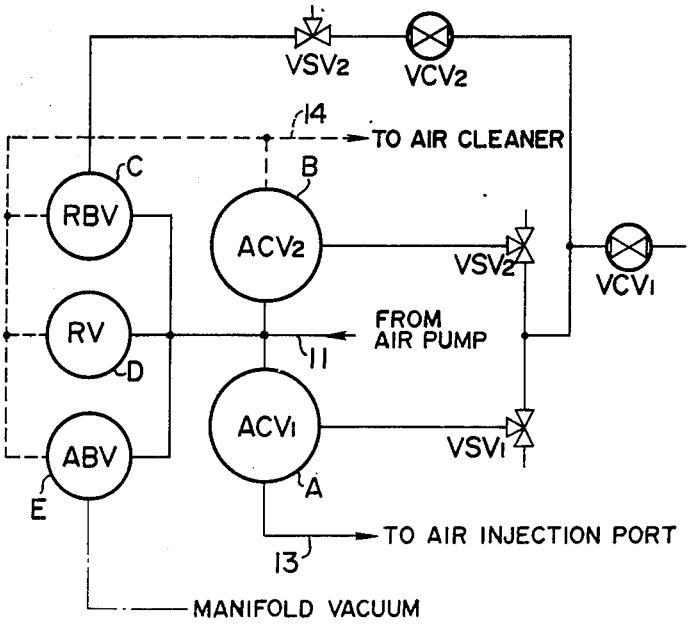
FIG. 8 is a diagram showing the operation system of the composite valve shown in FIGS. 1–7.

FIG. 8 is an operational diagram for the composite valve shown in FIGS. 1–7. In this case, the composite valve is adapted to operate as a control valve in a secondary air supply system for supplying secondary air to the exhaust system of an engine. In this case, the port 11 is supplied with secondary air delivered from an air pump, while the air delivered to the port 13 is conducted to an air injection port of the secondary air supply system. The port 14 serves to discharge excess air and is connected to an air cleaner of the engine so as to discharge the excess air into the air cleaner. The valve means A and B are air control valves $ACV_1$ and $ACV_2$ which are adapted to be oppositely operated in synchronization with each other by control vacuum supplied through vacuum control valve $VCV_1$ and vacuum switching valves $VSV_1$ and $VSV_2$ so as to supply a controlled portion of the air supplied from the air pump to the air injection port through $ACV_1$ while discharging the remaining portion toward the air cleaner through $ACV_2$. This changing-over operation is explained as follows, if referred to FIGS. 1–7: The air supplied through the port 11 is introduced into the passage 3*f*, wherefrom the air flows to the passage 2*a* if the valve element 5*a* is opened, thereby delivering air through the port 13. On the other hand, if the valve element 5*b* is opened, the air introduced into the passage 3*f* flows into the passage 2*b*, wherefrom it is discharged through the port 14 toward the air cleaner.

The valve means C provides a relief bypass valve RBV. This valve is controlled by vacuum supplied to the diaphragm chamber 1*c* through the vacuum control valve $VCV_2$ and the vacuum switching valve $VSV_2$ and operates so as to release the air supplied through the port 11 towards the air cleaner when it opens. Referring to FIGS. 1–7 in this connection, the air supplied to the passage 3*f* through the port 11 further flows through the passage 3*g* to the passage 3*h*, wherefrom it flows into the passage 2*c* if the valve element 5*c* is opened, so as to be discharged through the passage 2*b* and the port 14.

The valve means D provides a relief valve RV which protects the air pump from overloading. In more detail, if the delivery pressure of the air pump has risen beyond a predetermined value, this valve opens so as to release the air supplied through the port 11 towards the air cleaner through the port 14. Referring to FIGS. 1–7 in this connection, the air introduced into the passage 3*f* through the port 11 flows to the passage 2*d*, and if the valve element 5*d* is pushed up from the valve seat 10*d*, the air passes through the valve clearance to flow into the passage 3*j*, wherefrom it flows through the passages 2*c* and 2*b* to the port 14.

The valve means E provides an afterburn check valve ABV which is controlled by manifold vacuum introduced into the diaphragm chamber 3*k* formed on one side of the diaphragm portion 4*e* opposite to the side facing the concaved portion 1*e* in a manner that when the manifold vacuum has increased beyond a predetermined value, the valve is opened so as to release the secondary air supplied from the air pump toward the air cleaner. This is to prevent afterburn which might occur when the throttle valve is fully closed to decelerate a vehicle running at a relatively high speed, due to a great increase of manifold vacuum which causes abrupt evaporation of fuel droplets attached to the wall of the intake passage thereby causing rich fuel-air mixture which is mostly exhausted into the exhaust system as uncombusted mixture and is combusted in the exhaust system where secondary air is supplied. Referring to FIGS. 1–7 in this connection, the air introduced into the passage 3*f* through the port 11 flows to the passage 2*d*, and if the valve element 5*e* is opened, the air is then conducted through the passages 3*i*, 2*e*, and 2*c*, and then it further flows through the passage 2*b* to the port 14 so as to be discharged therefrom.

From the foregoing, it will be appreciated that the present invention only requires individually to produce first and second dish-like members, an intermediate member and a diaphragm element which are all relatively simple and effectively two-dimensional in structure, and several valve elements and valve seat elements which are also very simple in structure, and to assemble them together in an overlaying manner to provide a composite valve which incorporates a plurality of valve means adapted to operate in relation to one another, and is characterized by a simple design and a requirement for simpler and less expensive manufacturing and assembling processes.

Although the invention has been shown and described with respect to a preferred embodiment thereof, it should be understood by those skilled in the art that various changes and omissions of the form and detail thereof may be made therein without departing from the scope of the invention in accordance with the function or system of individual composite valves required.

We claim:

1. A composite valve comprising a first dish-like member having an open face and concaved portions which principally define a plurality of diaphragm chambers, a second dish-like member having an open face and concaved portions which principally define complex passages, an intermediate member having opposite open faces adapted to join said open faces of said first and second dish-like members and having complex partitions which principally define bearing portions and complex passages, a diaphragm element interposed between said open faces of said first dish-like member and said intermediate member, a plurality of valve elements having stem portions slidably mounted in said bearing portions and stem end portions connected to said diaphragm element, and valve seat elements interposed between said open faces of said second dish-like member and said intermediate member and providing valve seats which co-operate with said valve element.

2. The composite valve of claim 1, wherein said first and second dish-like members are clamped together with interposition of substantially said intermediate member by a number of bolts.

3. The composite valve of claim 1, wherein said diaphragm element has a plurality of diaphragm portions which individually provide diaphragm means co-operating with said diaphragm chambers.

4. The composite valve of claim 3, wherein a plurality of annular seal elements are provided individually to lie around said diaphragm portions.

5. The composite valve of claim 1, further comprising a modified valve element which has a disk portion directly connected to said diaphragm element, while said intermediate member further includes a valve seat portion which co-operates with said disk portion so as to perform its valving function.

6. The composite valve of calim 1, wherein said intermediate member further includes a concaved portion which defines a diaphragm chamber.

7. The composite valve of clam 1, incorporating first, second, third, fourth and fifth valve means each having inlet and outlet passages and first, second and third ports, said first port communicating to the inlet passages of said first to fifth valve means, said second port communicating to the outlet passage of said first valve means, said third port communicating with the outlet passages of said second to fifth valve means, said first and second valve means being air control valves of substantially the same structure and adapted to be oppositely operated by oppositely exchanged supply of vacuum, said third valve means being a relief bypass valve adapted to be selectively opened by selective supply of vacuum, said fourth valve means being a spring biased relief valve adapted to open when the fluid pressure existing in its inlet passage increases beyond a predetermined value, said fifth valve means being a spring biased vacuum operated valve adapted to open when the vacuum supplied to its diaphragm chamber increases beyond a predetermined value.

8. The composite valve of claim 7, wherein said valve is particularly adapted for use in a secondary air supply system for purifying exhaust gases from an engine, said first port being adapted to be supplied with secondary air delivered from an air pump, said second port being adapted to be connected to an air injection port in the exhaust system, said third port being adapted to discharge excess secondary air, said first and second valve means being adapted to be oppositely operated by a vacuum control and switching system, said third valve means being adapted to be operated by vacuum through a second vacuum control and switching system, and said fifth valve means being adapted to be operated by manifold vacuum.

* * * * *